United States Patent [19]

Kollmar

[11] Patent Number: 4,788,732

[45] Date of Patent: Dec. 6, 1988

[54] CLEANING DEVICE FOR AN ENDLESS WEB AND METHOD OF CLEANING

[76] Inventor: Ulrich Kollmar, Auf dem Berg 17, D-7520 Pforzheim-Würm, Fed. Rep. of Germany

[21] Appl. No.: 824,200

[22] Filed: Jan. 30, 1986

[30] Foreign Application Priority Data

Feb. 1, 1985 [DE] Fed. Rep. of Germany ... 8502656[U]

[51] Int. Cl.[4] ..... D06B 1/02

[52] U.S. Cl. ..... 8/158; 68/205 R

[58] Field of Search ..... 8/158, 151; 68/205 R; 239/557; 162/277

[56] References Cited

U.S. PATENT DOCUMENTS

| | | | |
|---|---|---|---|
| 3,135,653 | 6/1964 | Smith | 68/205 R |
| 3,468,362 | 9/1969 | Burkhardt | 134/122 R X |
| 3,739,605 | 6/1963 | Baker | 68/205 R X |
| 3,793,054 | 2/1974 | Franz . | |
| 3,910,815 | 10/1975 | Shelor | 162/277 X |
| 4,087,320 | 5/1978 | Danahy et al. | 134/122 R X |
| 4,397,694 | 8/1983 | Maxelon | 134/122 X |
| 4,605,472 | 8/1986 | Nakamura | 162/277 |

FOREIGN PATENT DOCUMENTS 1196049 2/1962 Fed. Rep. of Germany .

*Primary Examiner*—Harvey C. Hornsby
*Assistant Examiner*—Frankie L. Stinson
*Attorney, Agent, or Firm*—Spencer & Frank

[57] ABSTRACT

A cleaning device for cleaning a surface includes a spray pipe situated at a distance from, and generally parallel to the surface. The spray pipe has a plurality of spray nozzles having a predetermined spacing from one another along the spray pipe. Each spray nozzle has a spray width on the surface to be cleaned. There is further provided a drive for longitudinally displacing the spray pipe. The predetermined spacing is a multiple of the spray width, and further, the spray pipe has detent positions in a displacement path thereof. The number of the detent positions equals the ratio of the spacing to the width, and the distance between detent positions equals approximately the spray width at the most.

1 Claim, 1 Drawing Sheet

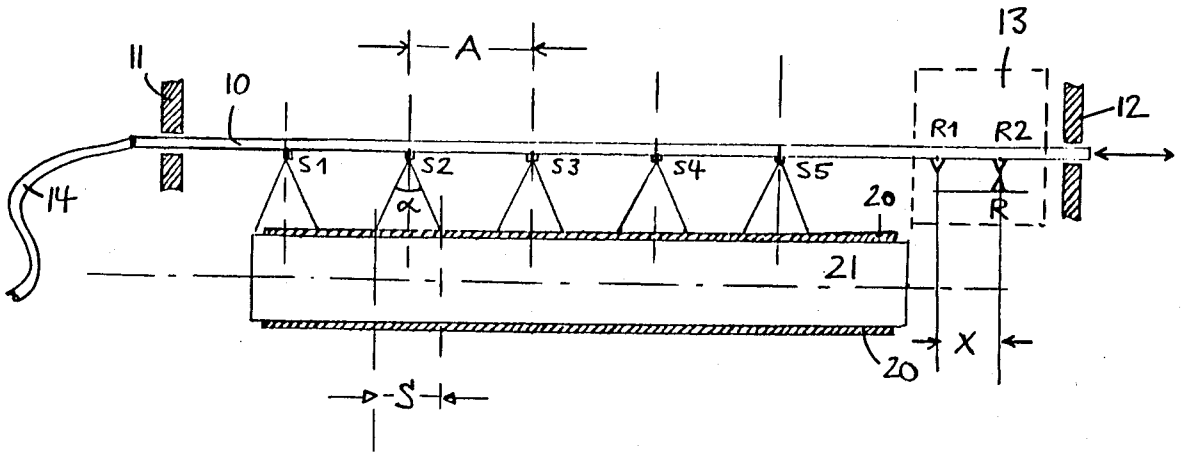
12
13
R2
R1
R
X
20
20
21
S5
S4
S3
S2
S1
A
α
S
10
11
14

CLEANING DEVICE FOR AN ENDLESS WEB AND METHOD OF CLEANING

The present invention relates to a cleaning device for an endless web and is of the type which includes a spray pipe equipped with a plurality of spray nozzles and being axially displaceable transversely to the endless web as well as a drive for the spray pipe. The spray nozzles have a given spacing from one another and a spray width on the web surface.

Endless webs are used, for example, as filter cloths in filter presses. The filter cloths have to be cleaned periodically. For this purpose, spray pipes are used which extend perpendicularly to the direction of movement of the endless web and which are equipped with a plurality of nozzles that spray a jet of water onto the web surface. The spray pipe moves continuously over a given path along its longitudinal axis to cause the spray nozzles to cover the entire web surface.

It has been found, however, that in the operating mode employed heretofore, in which the spray pipe is moved slowly or fast, there always remain surface areas which are not cleaned.

SUMMARY OF THE INVENTION

It is an object of the present invention to provide an improved cleaning device of the above type with which the endless webs are more reliably cleaned.

This is accomplished according to the present invention, according to which, briefly stated, the spacing of the spray nozzles is a multiple of the spray width and the spray pipe has, along its displacement path, detent positions whose number equals the ratio of the spacing between two adjoining spray nozzles to the nozzle spray width. The spacing of the detent positions approximately corresponds to the width of the spray or a fraction thereof.

With such an arrangement, the solution according to the invention permits timed operation in that during standstill of the spray pipe in a detent position, the spray nozzles charge the endless web in strips with a thorough cleaning effect, whereupon the spray pipe is moved to the next detent position and the spray nozzles then charge adjacent strips of the web.

The invention may readily be adapted to the most varied fields of use and cleaning requirements and permits minimum water consumption for a given cleaning quality.

BRIEF DESCRIPTION OF THE DRAWING

The sole FIGURE is a schematic elevational view of a preferred embodiment of the invention.

DESCRIPTION OF THE PREFERRED EMBODIMENT

Turning now to the Figure, a spray pipe 10 is mounted at its ends in bearings 11 and 12 for axial displacement and is supplied with spray water through a conduit 14. The spray water is discharged downwardly through nozzles S1, S2, S3, S4 and S5 onto an endless web 20 guided around a roller 21. The distance of the spray pipe 10 from the upper side of the endless belt 20 and the spray angle $\alpha$ are selected so that, with a given spacing A between adjoining spray nozzles S1 through S5, a spray width S results which covers part of the endless web 20. The spray angle $\alpha$ is preferably 30° or 45°.

In order to axially displace the spray pipe 10, the latter is guided in a drive 13 which may be operated hydraulically, pneumatically or electrically and which has a detent position R cooperating with two detent positions R1, R2 on the spray pipe 10. The distance x between the two detent positions R1 and R2 in the illustrated embodiment is selected to be equal to the spray width S. The number n of the detent positions is $n=A/S$, and A is a multiple of S. It is seen that in the illustrated exemplary embodiment, A is twice the length of S, and therefore the number of detent positions is two. The drive 13 may include a stepping mechanism with adjustable step lengths and a delay timer to advance the spray pipe 10 stepwise and cause it to dwell for predetermined periods in the detent positions along the displacement path of the spray pipe 10.

The cleaning device according to the invention operates as follows:

After a strip of the endless web 20 has been cleaned sufficiently in the illustrated position, drive 13 is actuated and thus displaces the spray pipe 10 to the right until the detent position R1 comes into engagement with detent position R of drive 13. In this position, the five spray nozzles S1 to S5 charge the strip areas of the endless web not previously affected and clean these regions as well.

It will be understood that the above description of the present invention is susceptible to various modifications, changes and adaptations, and the same are intended to be comprehended within the meaning and range of equivalents of the appended claims.

What is claimed is:

1. A method of cleaning a surface with a cleaning device including a spray pipe having a plurality of spray nozzles being at a predetermined spacing from one another along the spray pipe; comprising the steps of (a) situating the spray pipe generally parallel to said surface and at a distance therefrom for obtaining a predetermined spray width for each spray nozzle on the surface such that the predetermined spacing between spray nozzles is a multiple of the spray width;

(b) longitudinally displacing said spray pipe along an operational displacement path; and (c) repeatedly interrupting step (b) a number of times along the displacement path to effect spraying of the surface while the spray pipe is at a standstill; said number equalling the ratio of said spacing to said width, and the distance between standstill positions equalling approximately said spray width at the most.

* * * * *